US008342655B2

(12) United States Patent
Otaka et al.

(10) Patent No.: US 8,342,655 B2
(45) Date of Patent: Jan. 1, 2013

(54) LIQUID JET HEAD AND METHOD FOR MANUFACTURING LIQUID JET HEAD

(75) Inventors: Shimpei Otaka, Kawasaki (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 13/106,276

(22) Filed: May 12, 2011

(65) Prior Publication Data

US 2011/0279550 A1 Nov. 17, 2011

(30) Foreign Application Priority Data

May 17, 2010 (JP) ..... 2010-113431

(51) Int. Cl.
*B41J 2/14* (2006.01)
*B41J 2/16* (2006.01)

(52) U.S. Cl. ..... 347/50; 347/57; 347/58

(58) Field of Classification Search ..... 347/20, 347/49, 50, 54, 56–59
See application file for complete search history.

(56) References Cited

U.S. PATENT DOCUMENTS 7,475,964 B2 * 1/2009 Benson et al. ..... 347/50
7,547,094 B2 * 6/2009 Kawamura et al. ..... 347/50

FOREIGN PATENT DOCUMENTS

JP 2006-198937 A 8/2006

* cited by examiner

*Primary Examiner* — Juanita D Jackson
(74) *Attorney, Agent, or Firm* — Canon U.S.A., Inc., IP Division

(57) ABSTRACT

A liquid discharge head includes a recording element substrate including an energy generating element, a wiring substrate including wiring, a support substrate for supporting the recording element substrate and the wiring substrate so that a side end portion of the recording element substrate and a side end portion of the wiring substrate are adjacent to each other, and a sealing member, wherein the side end portion of the wiring substrate has a step portion, a distance between a second portion of the step portion on the side opposite to the support substrate and the side end portion of the recording element substrate is larger than a distance between a first portion of the step portion on the side of the support substrate and the side end portion of the recording element substrate, and a part of the wiring is formed in the first portion.

7 Claims, 16 Drawing Sheets

LIQUID JET HEAD AND METHOD FOR MANUFACTURING LIQUID JET HEAD

BACKGROUND OF THE INVENTION

1. Field of the Invention

The present invention relates to a liquid jet head for discharging liquid such as ink to perform recording and a method for manufacturing the liquid jet head.

2. Description of the Related Art

FIG. 12A illustrates a top view of a liquid jet head discussed in Japanese Patent Application Laid-Open No. 2006-198937. FIG. 12B illustrates a cross section taken along line A-A of the liquid jet head illustrated in FIG. 12A.

In FIGS. 12A and 12B, a recording element substrate 100 is provided with an energy generating element that generates discharge energy to discharge ink from a discharge port 101 and a supply port from which ink is supplied to the energy generating element. The recording element substrate 100 is bonded to a support substrate 130 with an adhesive or the like. A wiring substrate 110 is formed on the support substrate to electrically connect the recording element substrate 100 to an ink jet printer main body. The wiring substrate 110 is bonded to the support substrate 130 with an adhesive or the like along with the recording element substrate 100 and connected to electrical contacts of the recording element substrate 100 by bonding or the like. The wiring substrate 110 is provided with a device hole 115 which is an opening for exposing the recording element substrate 100 to the outside.

Generally, Si is used for the recording element substrate 100, and it is known that a sealing member is applied on an area between a side end surface of the wiring substrate and a side end surface of the recording element substrate inside the device hole to prevent the Si from being corroded by ink (see Japanese Patent Application Laid-Open No. 2006-198937).

The sealing member is applied by injecting a thermosetting sealing member in a liquid state between the side end surface of the wiring substrate 110 and the side end surface of the recording element substrate 100 inside the device hole 115 by using a needle and thermally curing the sealing member. When the sealing member is injected by inserting the top end of the needle into an area between the side end surface of the wiring substrate 110 and the side end surface of the recording element substrate 100, it is possible to reduce an amount of the sealing member in a liquid state that overflows onto the surface of the wiring substrate 110 or the surface of the recording element substrate 100.

These days, request for further downsizing and cost-cutting of a liquid discharge head has increased. To downsize a recording head, reducing the size of the wiring substrate 110 is one of effective measures. To reduce the size of the wiring substrate while maintaining the number of wirings formed in the wiring substrate and the arrangement density of the wirings, it is effective to reduce a gap between the side end surface of the wiring substrate that forms a device hole and the side end surface of the recording element substrate by reducing the size of the device hole of the wiring substrate. In this case, when injecting the sealing member, it is impossible to insert the top end of the needle that injects the sealing member between the side end surface of the wiring substrate and the side end surface of the recording element substrate, so that it is difficult to inject the sealing member. There is a method in which a thinner needle is used to inject the sealing member to insert the needle into a sealing area. However, when using a thin needle, an amount of sealing member that is injected per time reduces, so that it takes time to apply the sealing member and takt time increases. Thus, this is not preferable. Further, when using a thin needle, it is difficult to apply a sealing member having a high viscosity, so that selection of the type of sealing member is limited.

SUMMARY OF THE INVENTION

A liquid discharge head includes a recording element substrate including an energy generating element that generates energy used to discharge liquid from a discharge port, a wiring substrate including wiring electrically connected to the energy generating element, a support substrate for supporting the recording element substrate and the wiring substrate so that a side end portion of the recording element substrate and a side end portion of the wiring substrate are adjacent to each other, and a sealing member provided to fill a gap between the side end portion of the recording element substrate and the side end portion of the wiring substrate, wherein the side end portion of the wiring substrate has a step portion, a distance between a second portion of the step portion on the side opposite to the support substrate and the side end portion of the recording element substrate is larger than a distance between a first portion of the step portion on the side of the support substrate and the side end portion of the recording element substrate, and a part of the wiring is formed in the first portion.

Further, a method for manufacturing a liquid discharge head includes preparing a liquid discharge head having a recording element substrate including an energy generating element that generates energy used to discharge liquid from a discharge port, a wiring substrate including wiring electrically connected to the energy generating element, and a support substrate for supporting the recording element substrate and the wiring substrate so that a side end portion of the recording element substrate and a side end portion of the wiring substrate are adjacent to each other, wherein the side end portion of the wiring substrate has a step portion, a distance between a second portion of the step portion on the side opposite to the support substrate and the side end portion of the recording element substrate is larger than a distance between a first portion of the step portion on the side of the support substrate and the side end portion of the recording element substrate, and a part of the wiring is formed in the first portion, and filling a gap between the first portion of the step portion and the side end portion of the recording element substrate with a sealing member by disposing an injection port of a needle for injecting the sealing member between the second portion of the step portion and the side end portion of the recording element substrate and injecting the sealing member from the injection port.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 1 is a diagram illustrating a configuration of a first exemplary embodiment of a liquid discharge head.

FIG. 3 is a diagram illustrating a configuration of the first exemplary embodiment of the liquid discharge head.

FIG. 4 is a diagram illustrating a configuration of the first exemplary embodiment of the liquid discharge head.

FIG. 6 is a diagram illustrating a configuration of a second exemplary embodiment of the liquid discharge head.

FIG. 7 is a diagram illustrating a configuration of the second exemplary embodiment of the liquid discharge head.

FIG. 8 is a diagram illustrating a configuration of the second exemplary embodiment of the liquid discharge head.

FIG. 11 is a diagram illustrating a configuration of an implementation example of the liquid discharge heads according to an exemplary embodiment.

FIG. 12 is a diagram illustrating a configuration of a conventional liquid discharge head.

DESCRIPTION OF THE EMBODIMENTS

Various exemplary embodiments, features, and aspects of the invention will be described in detail below with reference to the drawings.

Figure 11A:
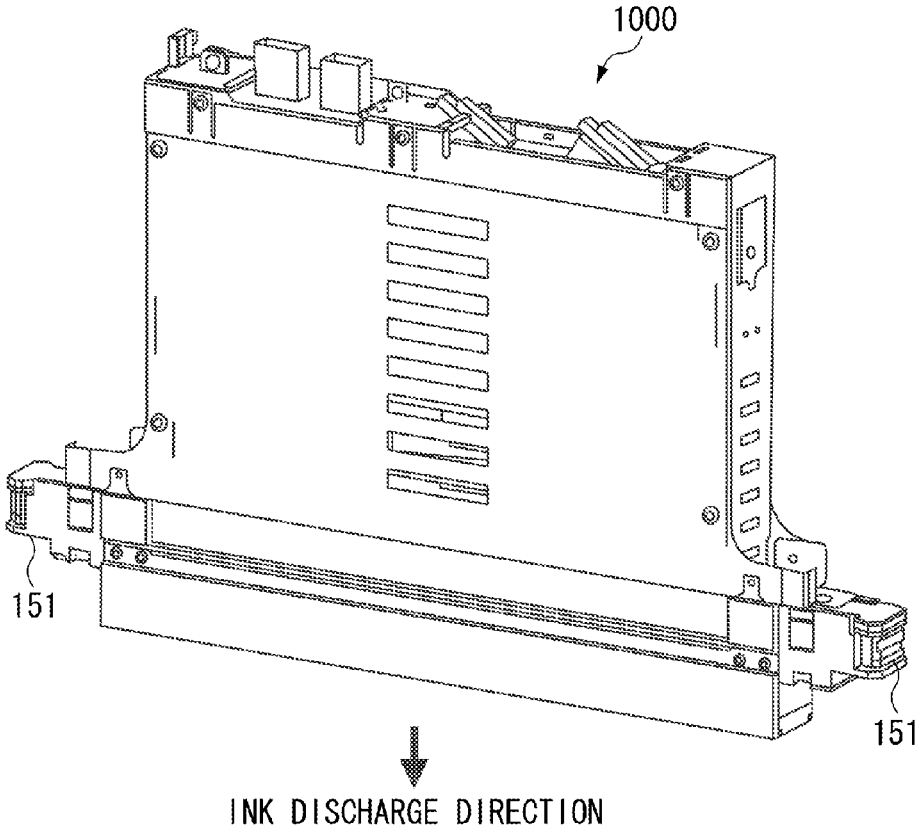
FIG. 11A is a perspective view of the configuration and FIG. 11B is a plan view of discharge port surfaces.
Figure 11B:
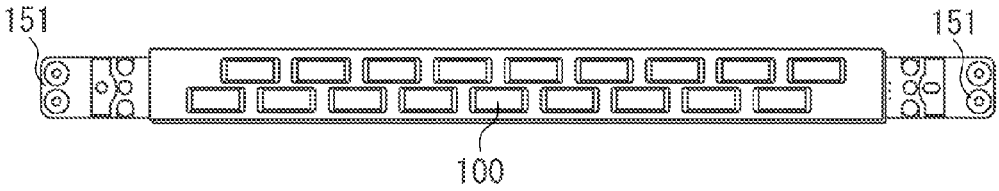
Figure 12A:
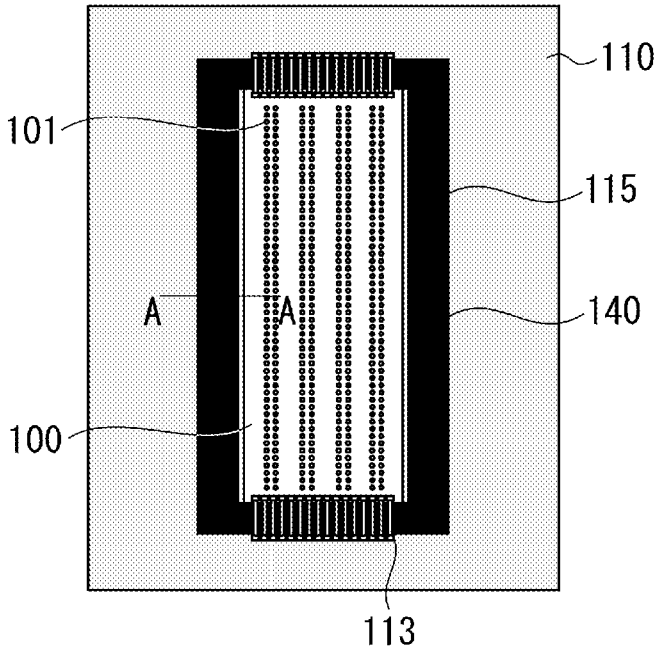
FIG. 12A (PRIOR ART)
FIG. 12A is a plan view and FIG. 12B is a side cross-sectional view of the configuration.
Figure 12B:
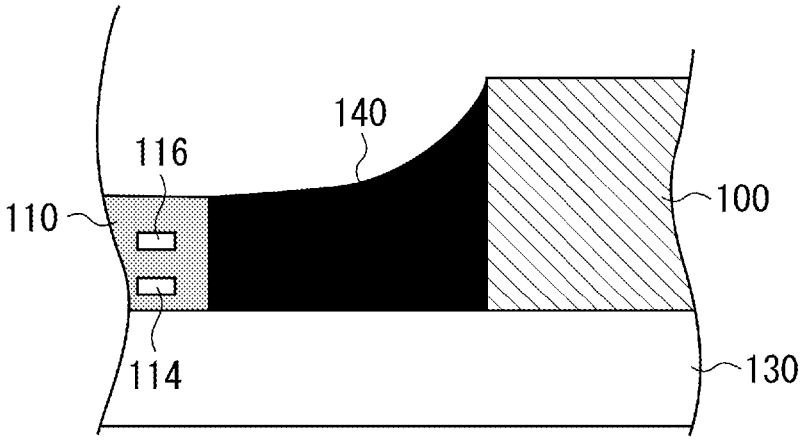
FIG. 12B (PRIOR ART)

FIGS. 11A and 11B illustrate an entire configuration of a liquid discharge head to which an exemplary embodiment is applied. A liquid discharge head 1000 according to the present exemplary embodiment has nozzle rows formed in a range covering a maximum width of a sheet assumed to be used. The liquid discharge head 1000 is a full-line type ink jet recording head that can perform wide-width recording with a single color without being scanned.

The liquid discharge head 1000 is provided with a plurality of recording element substrates 100. In the present exemplary embodiment, 18 recording element substrates are arranged in a zigzag pattern along a longitudinal direction of the liquid discharge head. An ink supply connection unit 151 communicating with the recording element substrates is formed at both ends in the longitudinal direction of the liquid discharge head. A configuration of one of the plurality of formed recording element substrates 100 will be described below as an example.

Figure 1A:
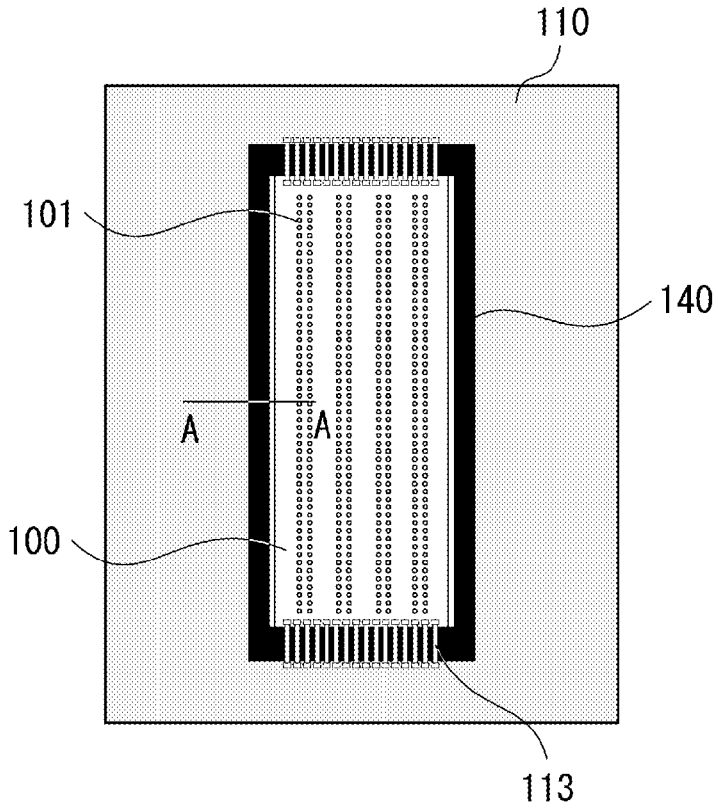
FIG. 1A is a plan view and FIG. 1B is a side cross-sectional view of the configuration.
Figure 1B:
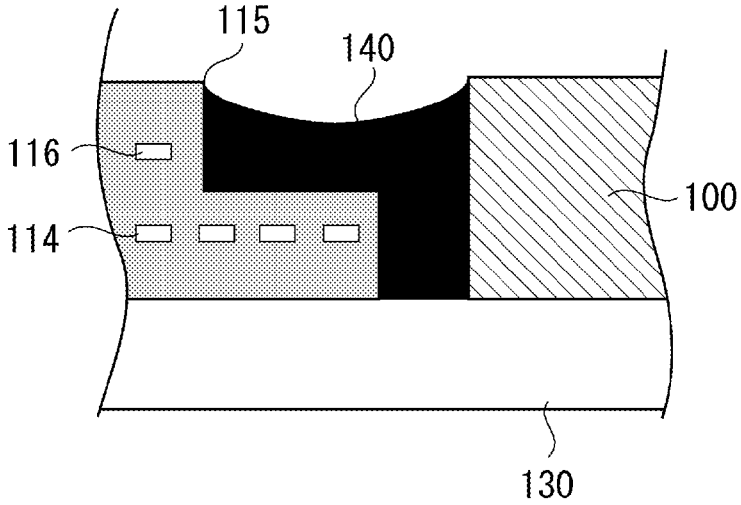

FIGS. 1A and 1B are diagrams illustrating a configuration of a first exemplary embodiment of the liquid discharge head. FIG. 1A is a plan view of a part of a surface, on which the recording element substrates of the liquid discharge head are arranged, as seen in an ink discharge direction. FIG. 1B is a cross-sectional view taken along line A-A in FIG. 1A.

In the liquid discharge head of FIG. 1A, a recording element substrate 100 including a discharge port that discharges liquid such as ink and an energy generating element that generates an energy used to discharge liquid and a wiring substrate 110 including a plurality of wirings are bonded to a support substrate 130 by an adhesive. The recording element substrate 100 and the wiring substrate 110 are electrically connected to each other via leads (wirings), and the wiring substrate 110 is electrically connected to an ink jet printer main body not illustrated in the figures. In the present exemplary embodiment, the support substrate 130 is formed of aluminum (aluminum oxide), and the recording element substrate 100 is formed from a silicon substrate and a resin substrate including discharge ports.

Although not illustrated in the figures, an opening for supplying ink to the recording element substrate 100 is formed in the support substrate 130 and the opening is connected to an ink supply port (not illustrated in the figures) formed in the recording element substrate 100.

A plurality of discharge ports 101 is formed in the recording element substrate 100 by photolithography. These discharge ports 101 are connected to the ink supplying opening of the support substrate 130 via a flow path and the ink supply port formed in the recording element substrate 100. In the present exemplary embodiment, the recording element substrate 100 is formed of a substrate of Si (silicon).

In the wiring substrate 110, an opening (device hole) 115 for exposing the recording element substrate 100 to the outside is formed. A sealing member is injected between aside end surface of the opening of the device hole 115 and a side end surface of the recording element substrate 100 to protect the side end surface of the recording element substrate 100 formed of silicon. As the sealing member, a thermosetting resin composition or the like is used. In the present exemplary embodiment, a thermosetting epoxy resin composition is used.

The liquid discharge head according to the present exemplary embodiment has a step portion where an end portion of the wiring substrate has a step shape to easily inject a sealing member in an area between a side end surface of the opening which is a side end portion of the device hole 115 of the wiring substrate 110 and a side end portion of the recording element substrate 100 formed adjacent to the side end surface of the opening. The configuration and manufacturing method of the liquid discharge head will be described below.

Figure 2:
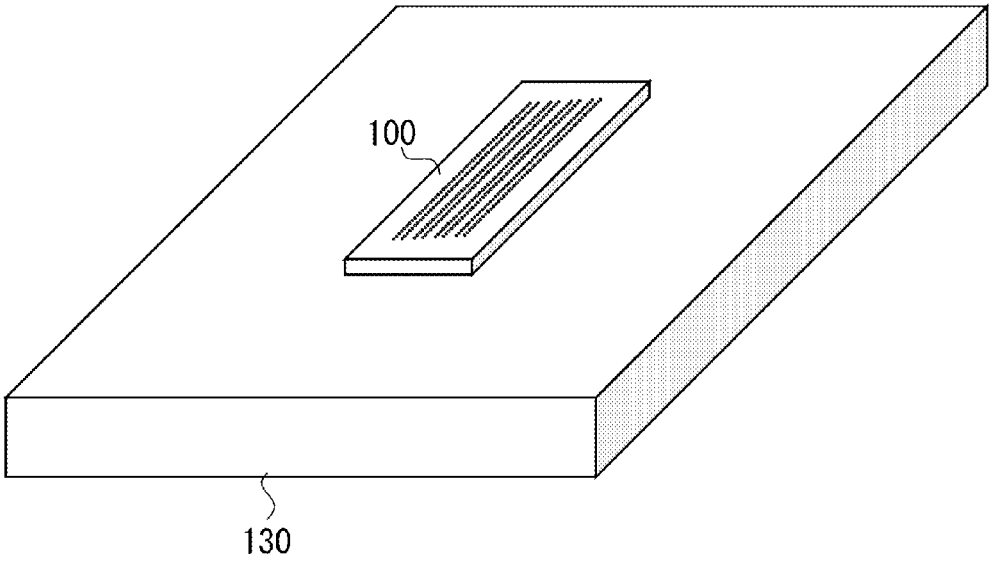
FIG. 2 is a perspective view illustrating a configuration of the first exemplary embodiment of the liquid discharge head.

First, as illustrated in FIG. 2, the recording element substrate 100 is bonded on the support substrate 130 by an adhesive. An opening (not illustrated in the figures) for supplying ink to the recording element substrate 100 is provided on the support substrate 130 and the recording element substrate 100 is positioned and bonded on the support substrate 130 so that the opening connects with the ink supply port of the recording element substrate. In the present exemplary embodiment, the bonding is performed by using an epoxy resin adhesive.

Figure 3A:
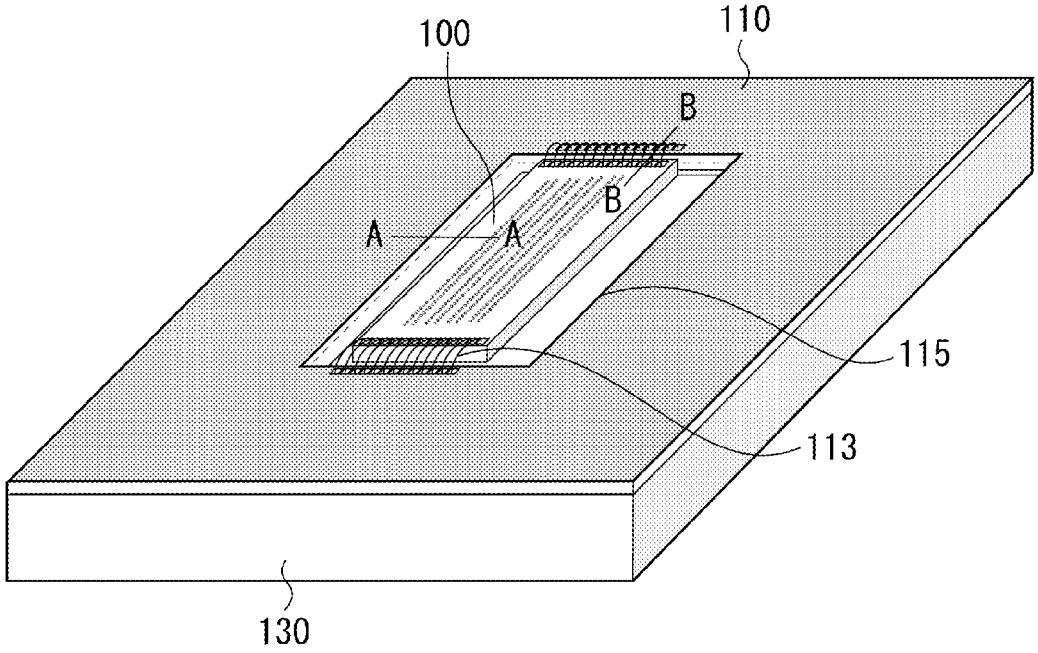
FIG. 3A is a perspective view and FIGS. 3B and 3C are side cross-sectional views of the configuration.
Figure 3B:
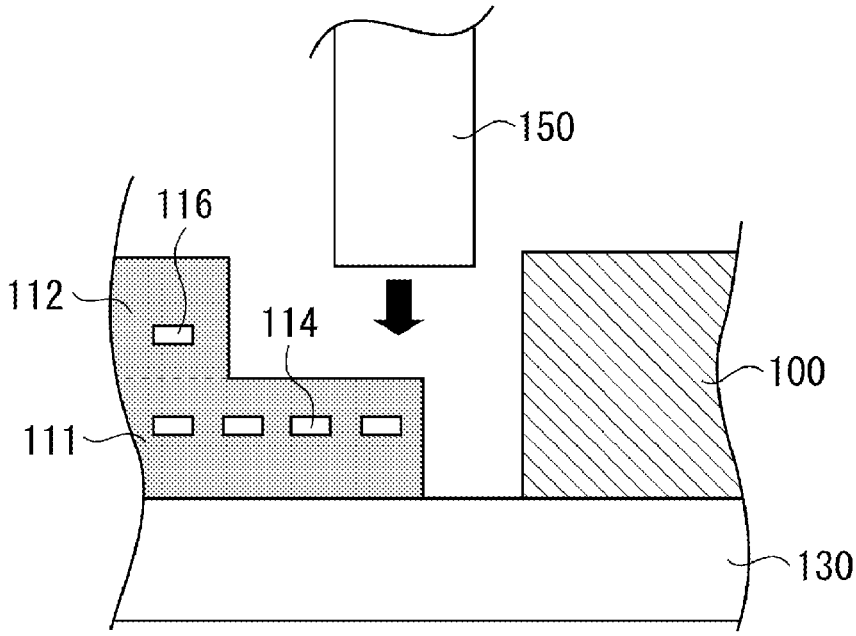
Figure 3C:
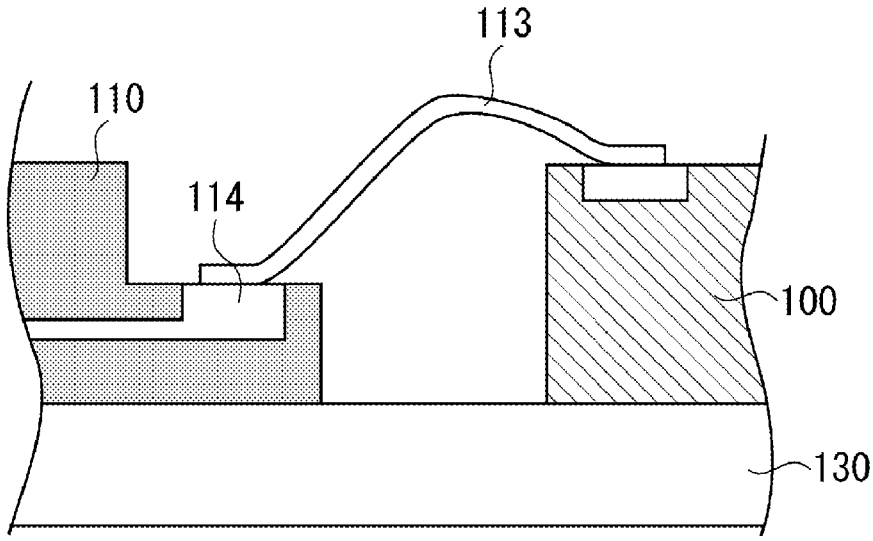

Next, as illustrated in FIG. 3A, the wiring substrate 110 is bonded on the support substrate 130 and the recording element substrate 100 and the wiring substrate 110 are electrically bonded to each other by forming leads by wire bonding as illustrated in FIG. 3C, which is a cross-sectional view taken along line B-B in FIG. 3A. The opening (device hole) 115 larger than the outer shape of the recording element substrate 100 is provided so that the opening does not interfere in the recording element substrate 100, and thus, the surface of the recording element substrate on which the discharge ports are formed is exposed to the outside. The wiring substrate 110 and the support substrate 130 are bonded to each other by an epoxy resin adhesive.

FIG. 3B illustrates a cross-sectional view taken along line A-A in FIG. 3. As illustrated in FIG. 3B, an end portion of the wiring substrate 110, which forms the device hole 115, has a two-step step portion.

The wiring substrate 110 according to the present exemplary embodiment has a two-layer structure including a first layer 111 formed on the side of the support substrate and a second layer 112 formed on the side of the surface of the wiring substrate 110 opposite to the support substrate. In the present exemplary embodiment, each of the first layer 111 and the second layer 112 of the wiring substrate 110 is formed from a plurality of layers as described below. The first layer 111 includes, in order from the side of the support substrate 130, a cover film formed of an aramid resin having a thickness of approximately 4 μm, an adhesive layer, a wiring layer formed of copper having a thickness of approximately 20 μm, an adhesive layer, and a base film formed of a polyimide resin having a thickness of approximately 25 μm. The second layer 112 formed on the first layer 111 includes, in order from the side of the first layer, a wiring layer formed of copper, an adhesive layer, and a cover film formed of an aramid resin. In the present exemplary embodiment, a configuration in which the cover film and the base film are exchanged is also effective.

As illustrated in FIG. 3B, wirings are formed in each of the first layer 111 and the second layer 112. In particular, in the present exemplary embodiment, the wirings 116, the number of which is smaller than the number of wirings in the first layer 111, is formed in the second layer 112. This is because the wirings are more reliably protected from ink incursion, external force, and the like coming from the outside when the wirings are formed in the first layer, which is the lower layer. Therefore, it is more preferable that the wirings 114 are formed only in the first layer which is the lower layer, and no wiring is formed in the second layer which is the upper layer. However, there is a case in which a necessary number of wirings cannot be formed only in the first layer and the wiring substrate needs to be enlarged. In such a case, a multi-layer wiring structure can be formed in which the wirings 116 are also formed in the second layer which is the upper layer so that the size of the wiring substrate need not be so much enlarged. Wirings in an area near the side end surface of the first layer 111 of the wiring substrate can also be formed to effectively use the area of the wiring substrate. Although the wiring substrate according to the present exemplary embodiment is configured to have a two-layer structure including the first layer and the second layer, the wiring substrate is formed as a single wiring substrate (integrated structure) in which the two layers are bonded to each other.

Hereinafter, a step structure of the wiring substrate 110, which is a feature of the present exemplary embodiment, will be described. In the present exemplary embodiment, the distance between the side end portion (end portion on the side of the support substrate) of the first layer 111 of the wiring substrate and the side end portion of the recording element substrate 100 is 0.2 mm. As the distance is set to approximately 0.2 mm as described above, the size of the device hole can be small. As a result, the wiring substrate 110 can be small, and then, the size of the support substrate 130 can be also small. However, when injecting a seal member into this area by using a needle 150, an injection amount per time is extremely limited when using a needle 150 having an outer diameter of 0.2 mm or less, thus this is not preferable when considering the production takt time.

However, in the present exemplary embodiment, the distance between the side end portion of the second layer 112 formed above the first layer, which is on the side of the surface of the wiring substrate, and the side end portion of the recording element substrate is set to 1.0 mm. Based on this, the side end portion of the wiring substrate 110 has a step structure. As described above, in the liquid discharge head according to the present exemplary embodiment, the distance between the side end portion of the wiring substrate on the side of the surface and the side end portion of the recording element substrate is larger than the distance between the side end portion of the wiring substrate on the side of the support substrate and the side end portion of the recording element substrate. Based on this, when a needle having an outer diameter of 0.81 mm is used, the top end of the needle (injection port) can be located at a position lower than the surface of the wiring substrate and the surface of the recording element substrate. Therefore, a sealing member can be easily injected. Further, when using a needle having an outer diameter of approximately 0.81 mm, it is possible to inject a sufficient amount of sealing member, so that the production takt time can be shortened. The distance between the side end portion of the second layer 112 and the side end portion of the recording element substrate 100 can be set so that the top end of the needle from which the sealing member is injected can be inserted in the area between the two side end portions. However, if the distance is too long, the amount of sealing member unnecessarily increases, so that the distance can be 0.5 to 4.0 mm.

Figure 4A:
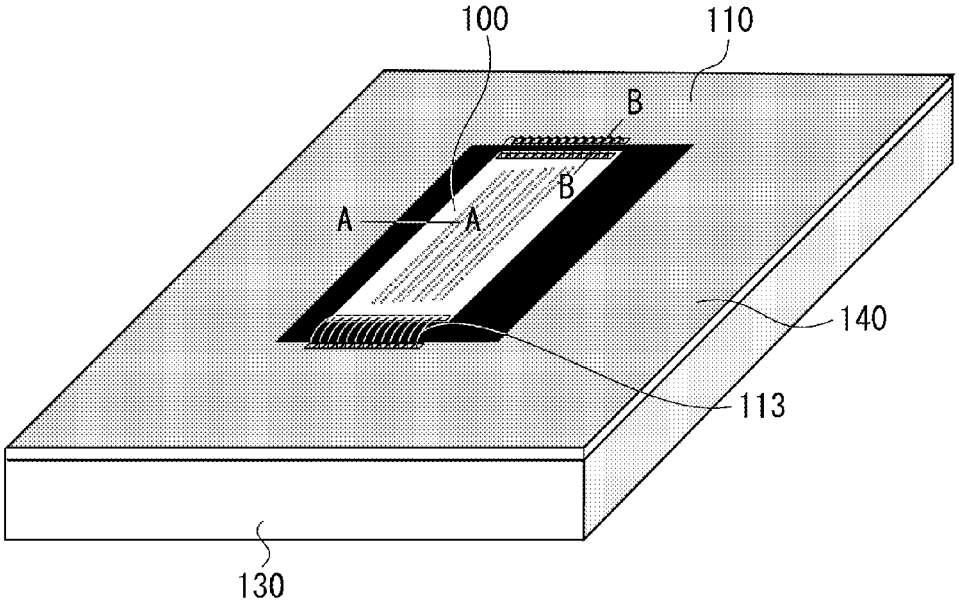
FIG. 4A is a perspective view and FIGS. 4B and 4C are side cross-sectional views of the configuration.
Figure 4B:
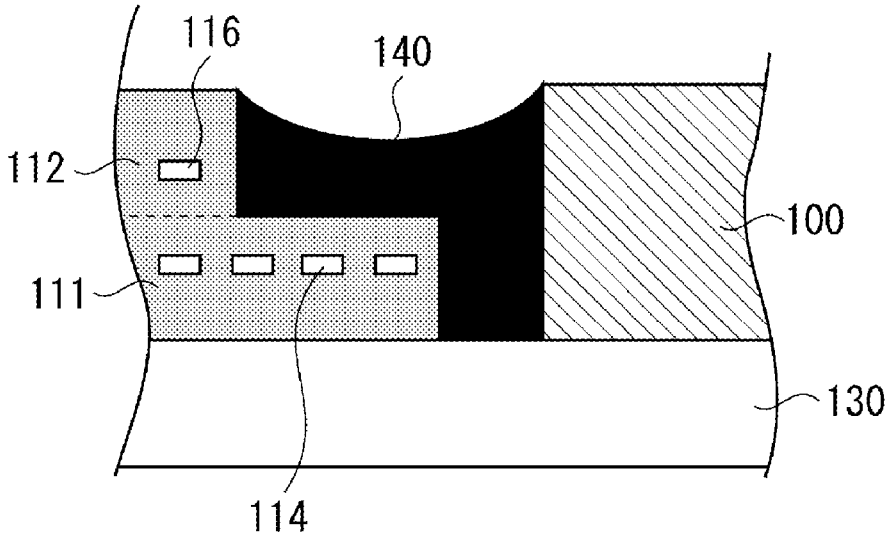
Figure 4C:
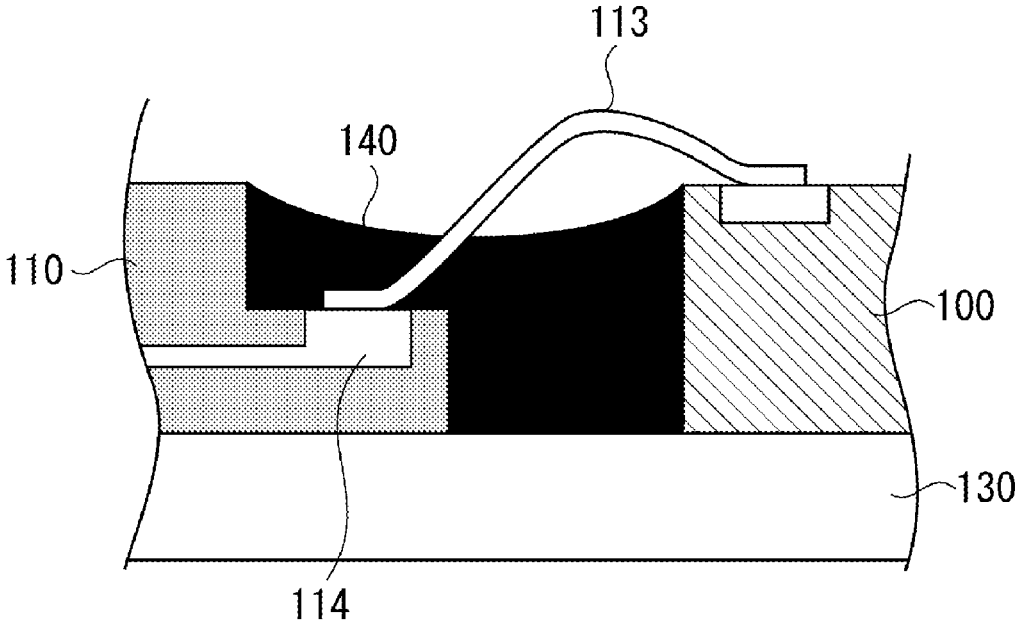

FIG. 4A illustrates a state in which a thermosetting sealing member is injected by a needle into an opening between the side end portion of the wiring substrate 110 and the side end portion of the recording element substrate 100. FIG. 4B illustrates a cross section taken along line A-A in FIG. 4A. FIG. 4C illustrates a cross section taken along line B-B in FIG. 4A. In the present exemplary embodiment, the thickness of the recording element substrate 100 is 0.625 mm, and the total thickness of the wiring substrate is 0.6 mm, which includes the thickness of 0.3 mm of the first layer 111 and the thickness of 0.3 mm of the second layer 112. The thickness of the second layer 112 is not particularly limited. If the thickness is 0.2 mm or more, the top end of the needle can be inserted and the sealing member can be easily injected. The total thickness of the first layer 111 and the second layer 112 of the wiring substrate is not particularly limited, and any thickness is possible if the side end portion of the recording element substrate can be coated with the sealing member.

Figure 5:
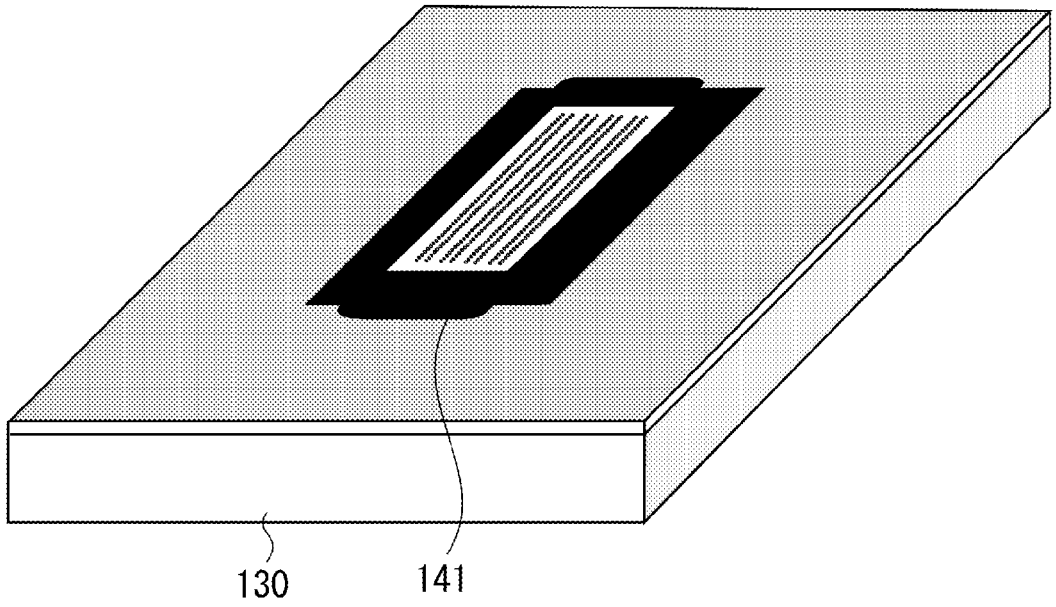
FIG. 5 is a perspective view illustrating a configuration of the first exemplary embodiment of the liquid discharge head.

Next, as illustrated in FIG. 5, a thermosetting sealing member 141 is coated on leads 113, and the sealing member 140 and the sealing member 141 are thermally cured to obtain the liquid discharge head. It is possible to protect the leads 113 from liquid and external force by the sealing member 141.

In the present exemplary embodiment, the two-step structure of the end portion of the wiring substrate is described, but it is not limited to this. The present invention can be applied to a structure having three or more steps if the size of the opening is secured so that the top end of the needle for injecting a sealing member can be inserted into a position lower than the top surface of the recording element substrate and the top surface of the wiring substrate on the side of the support substrate. Based on this structure, even when the sealing member spatters from the needle for injecting the sealing member, the amount of sealing member attached to the top surface of the recording element substrate and the surfaces of the discharge ports can be reduced.

In the above-described first exemplary embodiment, a structure in which a step structure is provided to a wiring substrate having a multi-layer structure is described. Next, an exemplary embodiment in which the sealing member can be easily injected by bonding a sheet member 120 on the wiring substrate 110 to form a step structure will be described. In the present exemplary embodiment, a step is formed at the end portion of the wiring substrate 110 by using the sheet member 120. Hereinafter, the present exemplary embodiment will be described in detail with reference to the drawings.

First, as illustrated in FIG. 2, the recording element substrate 100 is bonded to the support substrate 130. This operation is performed in the same procedure as that in the first exemplary embodiment.

Figure 6A:
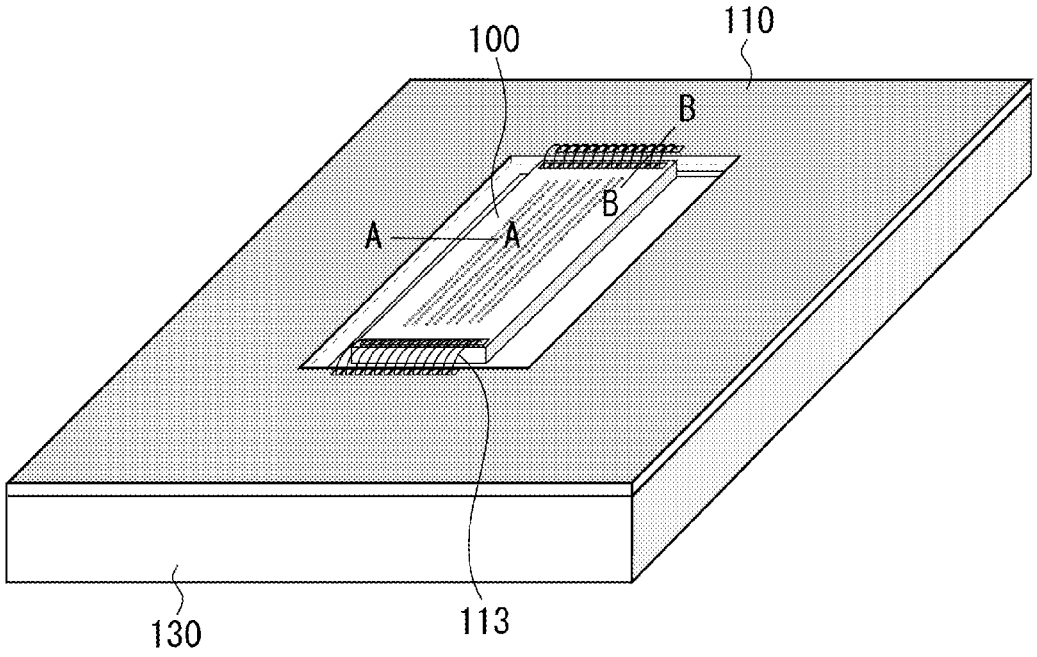
FIG. 6A is a perspective view and FIGS. 6B and 6C are side cross-sectional views of the configuration.
Figure 6B:
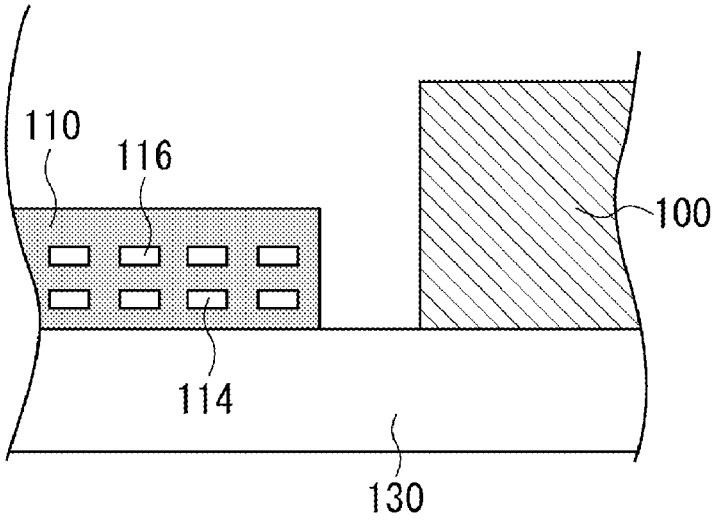
Figure 6C:
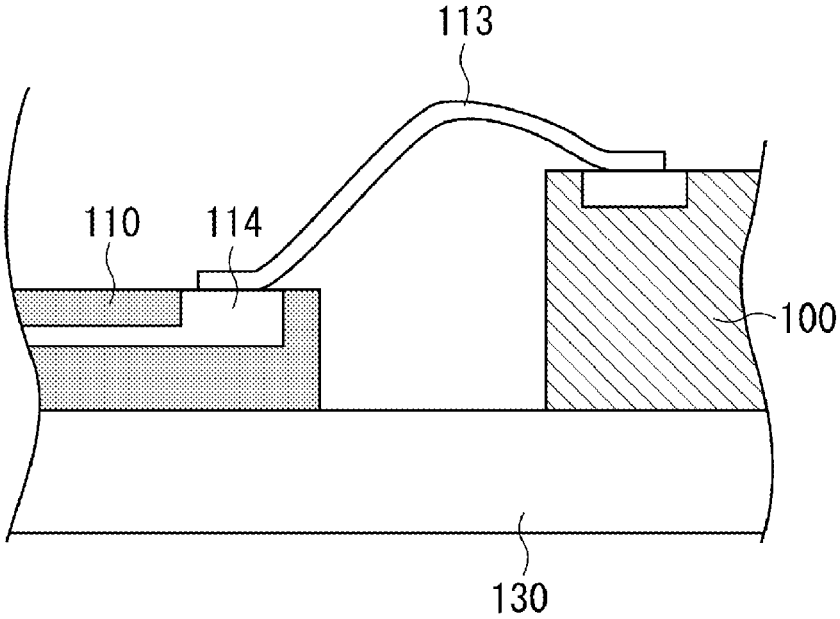

Next, as illustrated in FIG. 6A, the wiring substrate 110 is bonded on the support substrate 130 and the recording element substrate 100 and the wiring substrate 110 are electrically bonded to each other by wire bonding as illustrated in FIG. 6C, which is a cross-sectional view taken along line B-B in FIG. 6A. This bonding procedure is also the same as that in the first exemplary embodiment. FIG. 6B illustrates a cross section taken along line A-A in FIG. 6A. The present exemplary embodiment is different from the first exemplary embodiment in that the end portion of the wiring substrate 110 of the present exemplary embodiment has no step shape. Here, as illustrated in FIG. 6B, the wiring substrate 110 includes two wiring layers. As illustrated in FIG. 6B, in the wiring substrate, a cover film formed of an aramid resin having a thickness of approximately 4 μm, an adhesive layer, wirings 114 formed of copper having a thickness of approximately 20 μm, an adhesive layer, and a base film formed of a polyimide resin having a thickness of approximately 25 μm are laminated in order from the side of the support substrate 130. Further, an adhesive layer, wirings 116 formed of copper, an adhesive layer, and an aramid resin having a thickness of approximately 4 μm are laminated on the base film to form the wiring substrate 110. The lower wirings 114 and the upper wirings 116 are electrically connected through holes as needed. Electrical connection portions connected to the wirings 114 and the wirings 116 are formed on the surface of the wiring substrate 110, and the electrical connection portions and contact points formed on the recording element substrate 100 are electrically connected to each other by wirings such as leads. By employing such a multi-layer wiring structure, it is possible to form a wiring substrate including a large number of wirings without enlarging the area of the substrate. In the present invention, a configuration in which the cover film and the base film are exchanged is also effective.

Figure 7A:
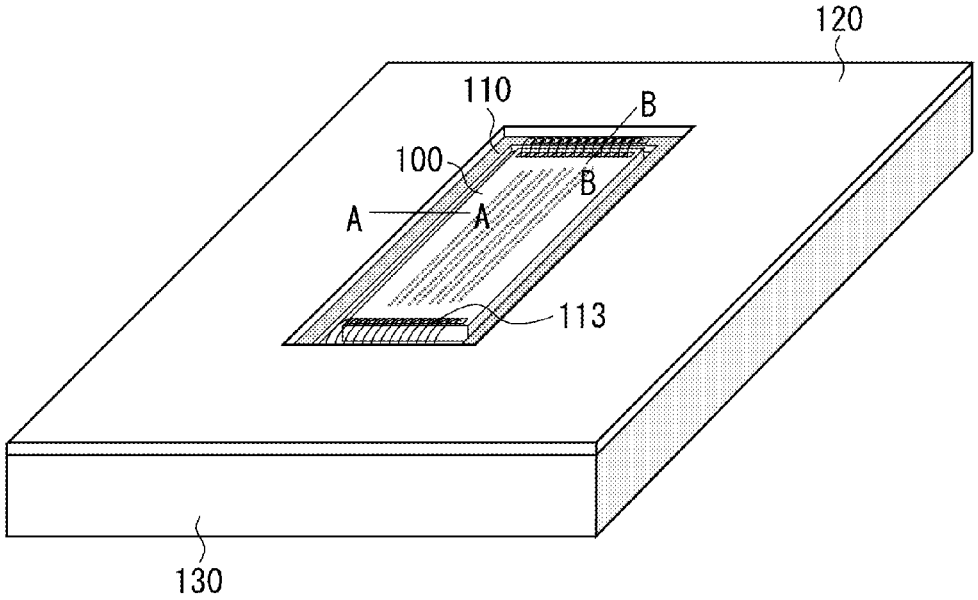
FIG. 7A is a perspective view and FIG. 7B is a side cross-sectional view of the configuration.

Next, as illustrated in FIG. 7A, the sheet member 120 is bonded on the wiring substrate 110 by an adhesive. A device hole (second opening), which is larger than the device hole (first opening) provided in the wiring substrate 110, is provided in the sheet member 120. The material of the sheet member 120 is not particularly limited, and a metal member or a resin member can be used if there is no problem in durability against ink and physical strength. In the present exemplary embodiment, the sheet member is formed of the same polyimide resin as that of the base film.

Figure 7B:
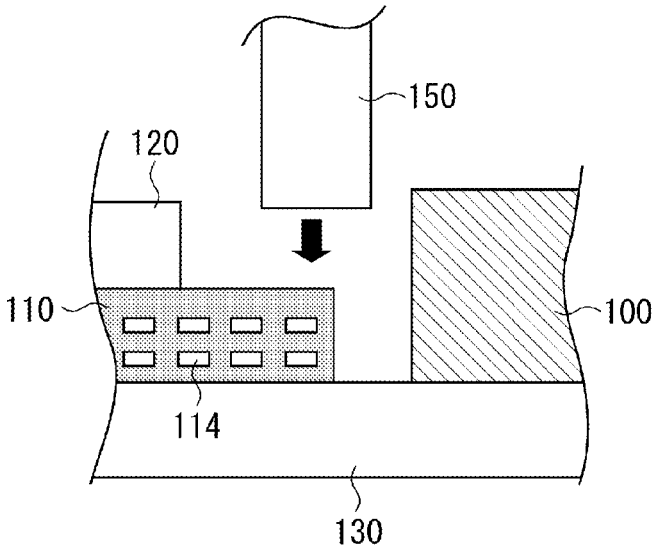
Figure 10:
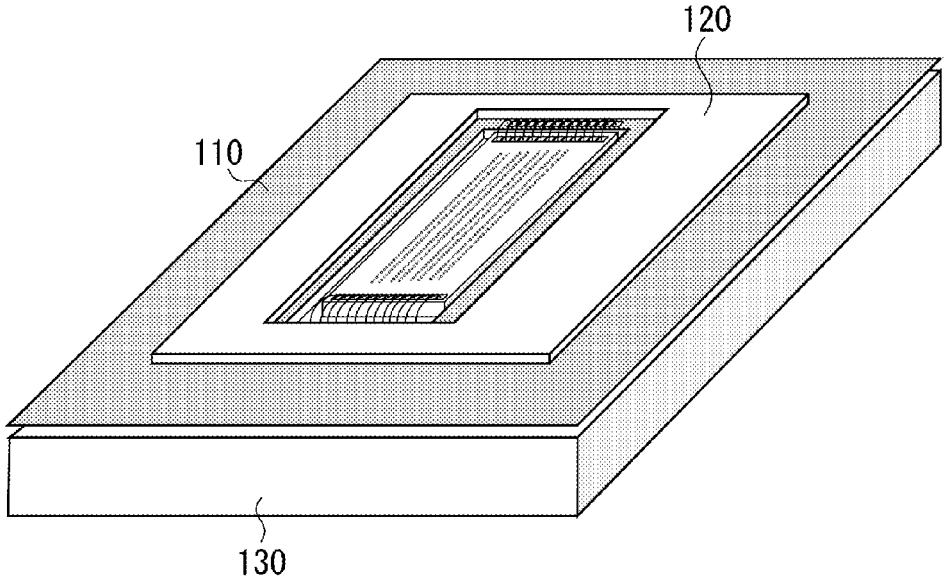
FIG. 10 is a perspective view illustrating a configuration of the second exemplary embodiment of the liquid discharge head.

FIG. 7B illustrates a cross section taken along line A-A in FIG. 7A. A step shape is formed in an area including the end portion of the wiring substrate 110 and the end portion of the sheet member 120 by bonding the sheet member 120 to the top surface of the wiring substrate 110. In the present exemplary embodiment, the distance between the side end surface of the wiring substrate 110 and the side end surface of the recording element substrate 100 is 0.2 mm in the same manner as in the first exemplary embodiment, and the distance between the side end surface of the sheet member 120 and the side end surface of the recording element substrate 100 is 1.0 mm. Therefore, when injecting a sealing member in the next process, it is possible to set the top end of the needle 150 at a point lower than the surface of the sheet member 120, so that the sealing member can be easily injected. In the present exemplary embodiment, a needle having an outer diameter of 0.81 mm is used. Although, in the present exemplary embodiment, the sheet member is disposed on the entire surface of the wiring substrate, there is no problem in a configuration in which the sheet member 120 is disposed only on the area surrounding the device hole of the wiring substrate 110 as illustrated in FIG. 10.

In the present exemplary embodiment, the thickness of the sheet member is 0.3 mm, the thickness of the wiring substrate is 0.3 mm, and the thickness of the recording element substrate 100 is 0.625 mm. When the thickness of the sheet member is 0.2 mm or more, the top end of the needle 150 can be easily inserted. The total thickness of the sheet member 120 and the wiring substrate 110 is not particularly limited, and any thickness is possible if the side end surface of the recording element substrate 100 can be coated with a sealing member.

Figure 8A:
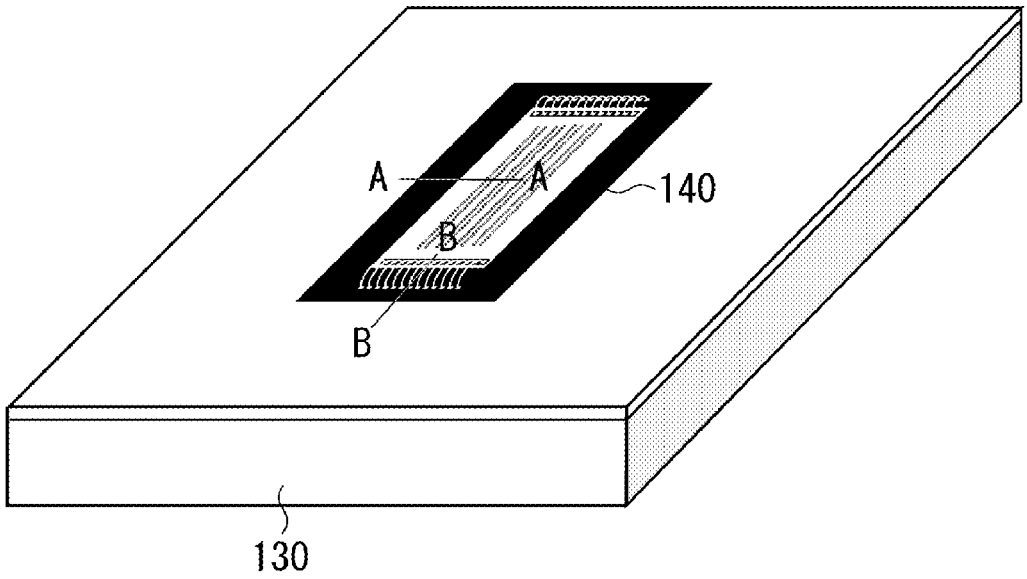
FIG. 8A is a perspective view and FIGS. 8B and 8C are side cross-sectional views of the configuration.
Figure 8B:
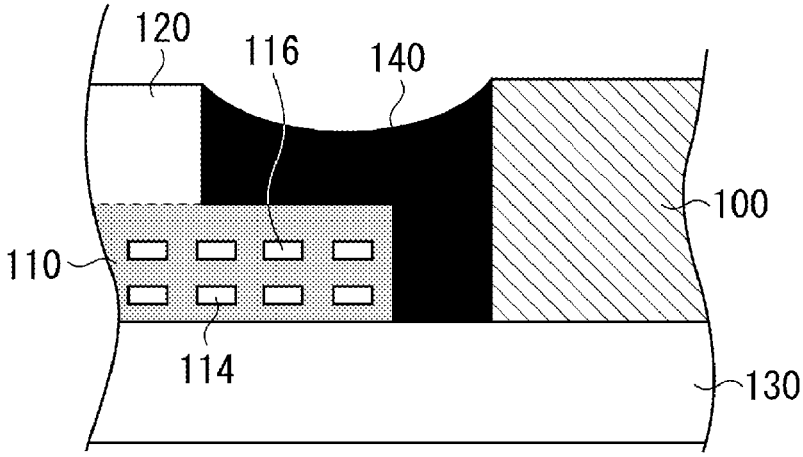
Figure 8C:
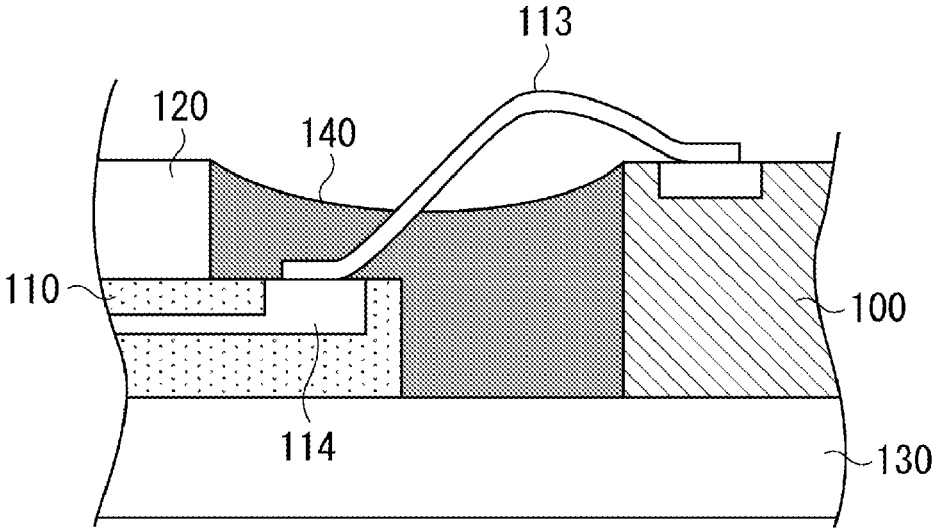

The liquid discharge head having the configuration described above is prepared and the sealing member 140 is injected between the wiring substrate 110 and the side end surface of the recording element substrate 100. As described above, the distance between the sheet member and the side end surface of the recording element substrate 100 is 0.8 mm and the thickness of the sheet member is 0.3 mm, so that the needle can be easily inserted and the sealing member 120 can be easily injected. FIG. 8B illustrates a cross-sectional view taken along line A-A in FIG. 8A. FIG. 8C illustrates a cross-sectional view taken along line B-B in FIG. 8A. In the same manner as in the first exemplary embodiment, a state in which the sealing member 140 is injected is illustrated.

Figure 9:
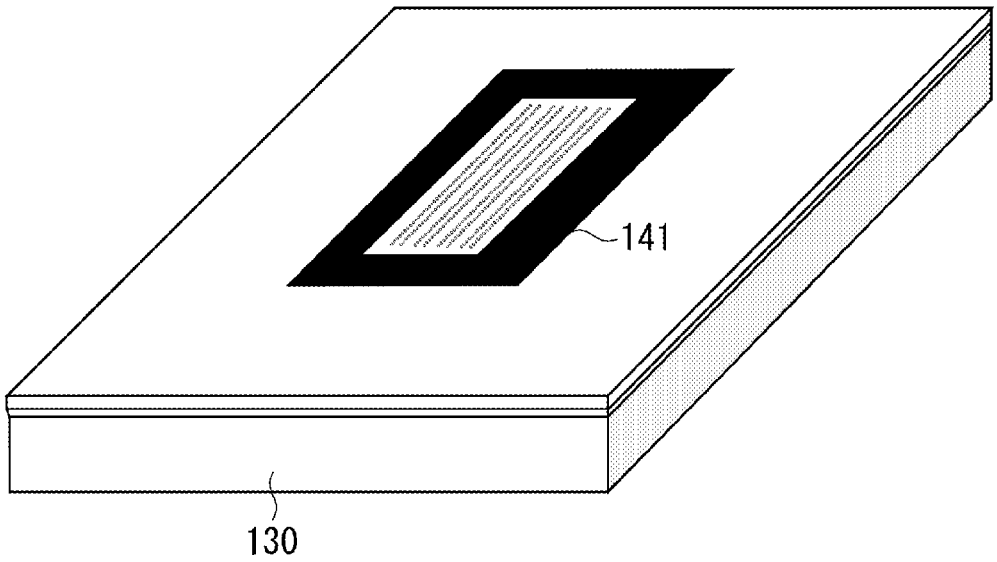
FIG. 9 is a perspective view illustrating a configuration of the second exemplary embodiment of the liquid discharge head.

Next, as illustrated in FIG. 9, the thermosetting sealing member 141 is coated on a wire bonding portion and the sealing member 140 and the sealing member 141 are thermally cured to obtain the liquid discharge head.

Although, in the above-described exemplary embodiments, the wiring substrate having a multi-layer wiring structure is described, the present invention is not limited to this, but the present invention can be applied to a wiring substrate having a single wiring layer.

Although, in the above-described exemplary embodiments, a full-line type liquid discharge head is described, the present invention is not limited to this, but the present invention can be applied to a scanning type liquid discharge head that performs printing while the liquid discharge head is scanning a recording medium.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-113431 filed May 17, 2010, which is hereby incorporated by reference herein in its entirety.

What is claimed is:

1. A liquid discharge head comprising:

a recording element substrate including an energy generating element that generates energy used to discharge liquid from a discharge port;

a wiring substrate including wiring electrically connected to the energy generating element;

a support substrate for supporting the recording element substrate and the wiring substrate so that a side end portion of the recording element substrate and a side end portion of the wiring substrate are adjacent to each other; and a sealing member provided to fill a gap between the side end portion of the recording element substrate and the side end portion of the wiring substrate, wherein the side end portion of the wiring substrate has a step portion, a distance between a second portion of the step portion on the side opposite to the support substrate and the side end portion of the recording element substrate is larger than a distance between a first portion of the step portion on the side of the support substrate and the side end portion of the recording element substrate, and a part of the wiring is formed in the first portion.

2. The liquid discharge head according to claim 1, wherein, with respect to a thickness direction of the wiring substrate, the number of wirings formed in an area of the wiring substrate on the side of the support substrate is greater than the number of wirings formed in an area of the wiring substrate on the side opposite to the support substrate.

3. A liquid discharge head comprising:

a recording element substrate including an energy generating element that generates energy used to discharge liquid from a discharge port;

a wiring substrate including wiring electrically connected to the energy generating element;

a support substrate for supporting the recording element substrate and the wiring substrate so that a side end portion of the recording element substrate and a side end portion of the wiring substrate are adjacent to each other;

a sheet member provided on the wiring substrate so that a side end portion of the recording element substrate and a side end portion of the sheet member provided on the wiring substrate are adjacent to each other; and a sealing member provided to fill a gap between the side end portion of the recording element substrate and the side end portions of the wiring substrate and the sheet member, wherein a distance between the side end portion of the sheet member and the side end portion of the recording element substrate is larger than a distance between the side end portion of the wiring substrate and the side end portion of the recording element substrate.

4. A method for manufacturing a liquid discharge head, the method comprising:

preparing a liquid discharge head including a recording element substrate including an energy generating element that generates energy used to discharge liquid from a discharge port, a wiring substrate including wiring electrically connected to the energy generating element, and a support substrate for supporting the recording element substrate and the wiring substrate so that a side end portion of the recording element substrate and a side end portion of the wiring substrate are adjacent to each other, wherein the side end portion of the wiring substrate has a step portion, a distance between a second portion of the step portion on the side opposite to the support substrate and the side end portion of the recording element substrate is larger than a distance between a first portion of the step portion on the side of the support substrate and the side end portion of the recording element substrate, and a part of the wiring is formed in the first portion; and filling a gap between the first portion of the step portion and the side end portion of the recording element substrate with a sealing member by disposing an injection port of a needle for injecting the sealing member between the second portion of the step portion and the side end portion of the recording element substrate and injecting the sealing member from the injection port.

5. The method for manufacturing a liquid discharge head according to claim 4, wherein a distance between the second portion of the step portion and the side end portion of the recording element substrate is greater than an outer diameter of the needle and a distance between the first portion of the step portion and the side end portion of the recording element substrate is smaller than the outer diameter of the needle.

6. A method for manufacturing a liquid discharge head, the method comprising:

preparing a liquid discharge head including a recording element substrate including an energy generating element that generates energy used to discharge liquid from a discharge port, a wiring substrate including wiring electrically connected to the energy generating element, a support substrate for supporting the recording element substrate and the wiring substrate so that a side end portion of the recording element substrate and a side end portion of the wiring substrate are adjacent to each other, and a sheet member provided on the wiring substrate so that a side end portion of the recording element substrate and a side end portion of the sheet member provided on the wiring substrate are adjacent to each other, wherein a distance between the side end portion of the sheet member and the side end portion of the recording element substrate is larger than a distance between the side end portion of the wiring substrate and the side end portion of the recording element substrate, and filling a gap between the side end portion of the wiring substrate and the side end portion of the recording element substrate with a sealing member by disposing an injection port of a needle for injecting the sealing member between the side end portion of the sheet member and the side end portion of the recording element substrate and injecting the sealing member from the injection port.

7. The method for manufacturing a liquid discharge head according to claim 6, wherein a distance between the side end portion of the sheet member and the side end portion of the recording element substrate is greater than an outer diameter of the needle and a distance between the side end portion of the wiring substrate and the side end portion of the recording element substrate is smaller than the outer diameter of the needle.

* * * * *